US008899473B2

(12) United States Patent
Tibbels et al.

(10) Patent No.: US 8,899,473 B2
(45) Date of Patent: Dec. 2, 2014

(54) CONTAINER HAVING AN INTEGRAL DIVIDER

(75) Inventors: Brian J. Tibbels, Cochranville, PA (US); Carl J. Jolley, Plymouth Meeting, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 757 days.

(21) Appl. No.: 12/023,360

(22) Filed: Jan. 31, 2008

(65) Prior Publication Data

US 2009/0084835 A1 Apr. 2, 2009

Related U.S. Application Data

(60) Provisional application No. 60/975,664, filed on Sep. 27, 2007.

(51) Int. Cl.

| | |
|---|---|
| ***B65D 5/4805*** | (2006.01) |
| ***B65D 25/04*** | (2006.01) |
| ***B65D 5/488*** | (2006.01) |
| ***B65D 5/48*** | (2006.01) |

(52) U.S. Cl.

CPC ..... *B65D 5/48014* (2013.01)
USPC ..... 229/120.18; 229/120.08

(58) Field of Classification Search

CPC ..... B65D 5/48014; B65D 5/0281; B65D 5/3621; B65D 5/48048; B65D 2571/0066; B65D 2571/00388
USPC ..... 229/120.18, 120.08, 120.11, 120.37, 229/120.02, 120.05, 120.04, 120.31, 229/120.27, 120.09, 120.24, 120.15, 229/120.14, 120.03, 120.26; 206/193, 194, 206/196, 197, 422

See application file for complete search history.

(56) References Cited

U.S. PATENT DOCUMENTS

| | | | | |
|---|---|---|---|---|
| 2,825,496 | A * | 3/1958 | Miessler, Sr. | 206/422 |
| 3,563,449 | A * | 2/1971 | Forbes, Jr. | 229/120.01 |
| 4,482,055 | A * | 11/1984 | Boyle | 229/235 |
| 4,541,560 | A * | 9/1985 | Fischer | 229/120.18 |
| 5,088,641 | A * | 2/1992 | Shepard | 229/120.17 |
| 5,465,834 | A * | 11/1995 | Sieber et al. | 206/193 |
| 5,979,645 | A | 11/1999 | Holley, Jr. | |
| 6,871,778 | B2 * | 3/2005 | Petrelli et al. | 229/120.18 |

* cited by examiner

*Primary Examiner* — Gary Elkins
*Assistant Examiner* — Christopher Demeree
(74) *Attorney, Agent, or Firm* — Fox Rothschild LLP

(57) ABSTRACT

A sustainable container includes panels attached to one another to form sidewalls surrounding a central space, and flaps extending from the sidewalls to form a bottom. A divider panel attached to at least one of the panels has upper and lower portions separated by an opening. The container is assembleable from a knockdown state, in which the upper and lower portions of the divider panel are disposed substantially in a single plane of the divider panel, to an assembled state, in which the upper and lower portions of the divider panel are folded in opposite respective directions out of the plane. The upper portion of the divider panel separates first and second cells of the container, and the lower portion of the divider panel separates second and third cells of the container, when the container is in the assembled state.

20 Claims, 7 Drawing Sheets

100
10
46
44
9
60
23
20
24
24c
42a
10
23
24b
14d
24a
9
48
42
18
20
42b
10
90c
12c
12a
90b
14b
16
25
22
25
12d
12e
60
14a 10
22
64
40
50

5/7
P
L
2W
W
90
62
62a
60
76
46
44
42a
23
14d
12a
12b
25
32a
14c
12c
34
90b
74
14b
24b
72
36
42b
90b
12e
70
12d
24a
64a
64
90a
14a
32b
25
38
L

CONTAINER HAVING AN INTEGRAL DIVIDER

CROSS-REFERENCE TO RELATED APPLICATION

This claims the benefit of U.S. Provisional Patent Application No. 60/975,664, filed Sep. 27, 2007, the entire disclosure of which is hereby incorporated herein by reference.

FIELD OF THE INVENTION

The present invention relates generally to containers used for packaging and shipping objects. More particularly, the invention relates to containers, such as corrugated paperboard boxes that have internal divider panels, and that are suitable for use as sustainable packaging.

DISCUSSION OF RELATED ART

In today's manufacturing environment, many products are produced using by multiple processing steps that are performed in geographically diverse locations. For example, a part or component manufacturer may be located in a geographic location different from that of an assembly facility. By way of further example, a manufacturer of bottles for holding consumer grade laundry detergents may be located in a geographic location different from that of a filling facility that fills the bottles with a laundry detergent product. Traditionally, the facility receiving the parts/components/objects (the "receiving facility") is tasked with handling or disposing of the packaging and/or shipping containers after the part or component has been removed. While cardboard and other packaging materials may be recyclable, they are not always recycled by the receiving facility. Thus, in many cases, the packaging and/or shipping containers received by the receiving facility are discarded as waste, which is expensive and can be harmful to the environment. Further, the receiving facility is responsible for packaging and shipping products after it has completed its manufacturing operations.

Certain manufacturing processes are automated and include pick-and-place or other automated operations that require that certain packaged objects be positioned in the container in an expected manner when received. For example, certain bottle filling equipment requires that bottles be positioned in predetermined positions relative to a shipping container so they may be reliably picked up by mechanized equipment and/or filled in situ during such operations. Many common shipping containers cannot ensure the required positional accuracy or consistency. This is particularly true for irregularly shaped bottles or other objects, which may not be shaped so as to prevent undesired relative movement when packaged within a common container.

Accordingly, it is desirable to have a sustainable container that may be used for shipping products/objects between geographically diverse locations throughout the manufacturing and/or distribution processes. Further, it is desirable to have a sustainable container that adequately protects its contents from damage, and maintains positional constancy facilitating pick-and-place or other automated operations, even for asymmetrically shaped objects.

SUMMARY OF THE INVENTION

An embodiment of the present invention provides a sustainable container that may be reused to transport objects between geographically diverse locations throughout a manufacturing and/or distribution process. The container has an integral internal divider that protects its contents from damage during shipment, and maintains each of the contents within a predetermined range of positions within the container, thus facilitating pick-and-place or other automated operations from locations within the container, even for asymmetrically shaped objects, such as many conventional detergent bottles.

An exemplary container includes a plurality of panels attached to one another to form a plurality of sidewalls surrounding a central space and a plurality of flaps extending from the sidewalls to form a bottom of the container. The container further includes a divider panel attached to at least one of the panels. The divider panel has upper and lower portions separated by an opening. The container is assembleable from a knockdown state to an assembled state. In the knockdown state, the upper and lower portions of the divider panel are disposed substantially in a single plane of the divider panel. In the assembled state, the upper and lower portions of the divider panel are folded in opposite respective directions out of the plane. The upper portion of the divider panel separates first and second cells of the container when the container is in the assembled state. The lower portion of the divider panel separates second and third cells of the container when the container is in the assembled state.

DETAILED DESCRIPTION

Figure 1:
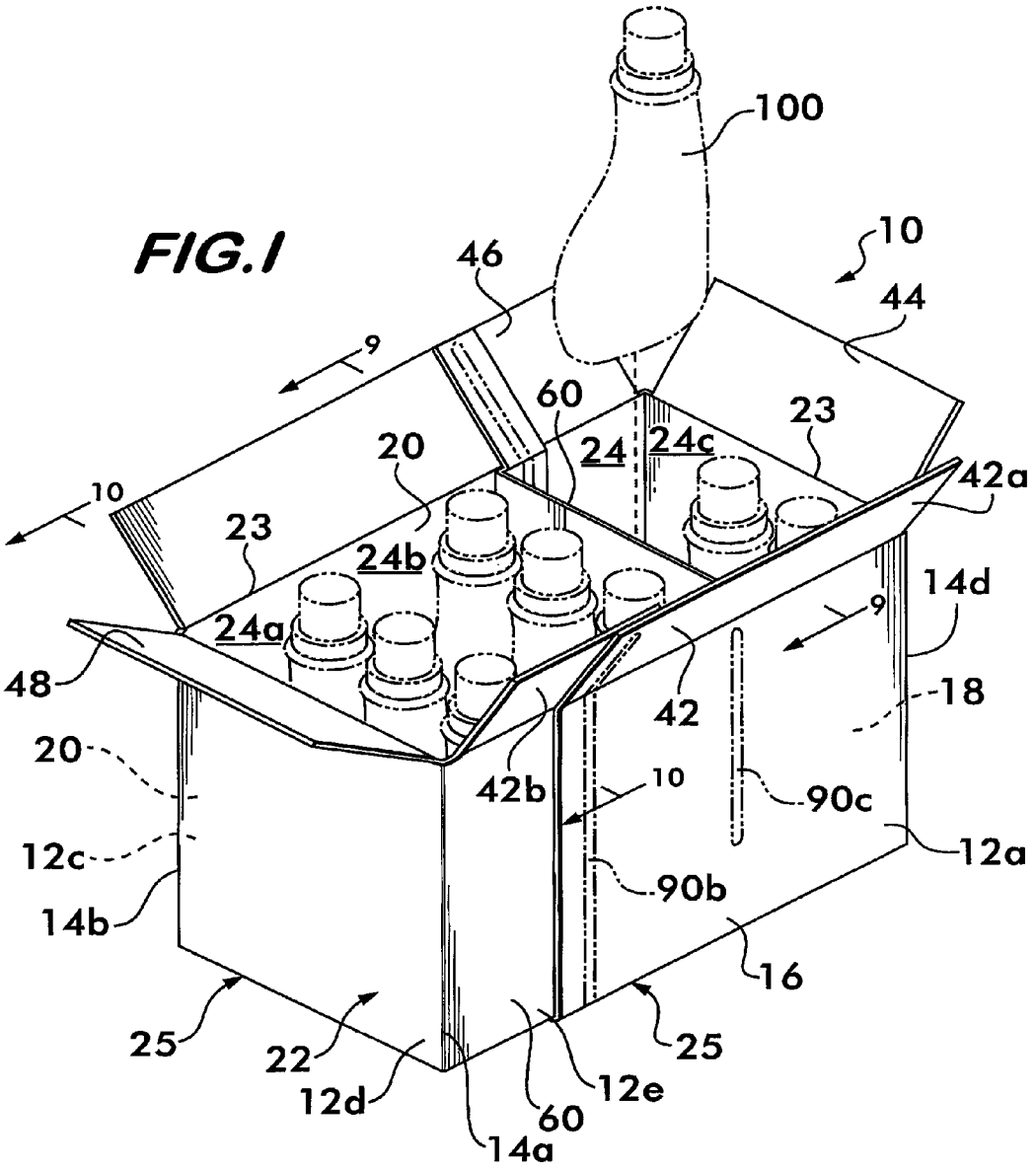
FIG. 1 is a perspective view of a sustainable container with integral divider in accordance with an exemplary embodiment of the present invention.

FIG. 1 shows an exemplary container 10 in accordance with the present invention. Container 10 is preferably formed of a stiff, lightweight substrate such as corrugated paperboard, and is sustainable in that it is readily recyclable. The container 10 comprises a plurality of panels 12*a*, 12*b*, 12*c*, 12*d*, 12*e* attached to one another along adjacent side edges

14*a*, 14*b*, 14*c*, 14*d* to form a plurality of sidewalls 16, 18, 20 and 22 of the container 10. It will be noted that in this embodiment, panels 12*a* and 12*e* cooperate to form sidewall 16. The sidewalls surround a central space 24 into which objects are placed for storage and transport. In FIG. 1, the container 10 is depicted with an open top to illustrate how the central space may receive objects, such as exemplary bottle 100. Each panel 12*a*, 12*b*, 12*c*, 12*d*, 12*e* has a respective top edge 23 and bottom edge 25.

Figure 2:
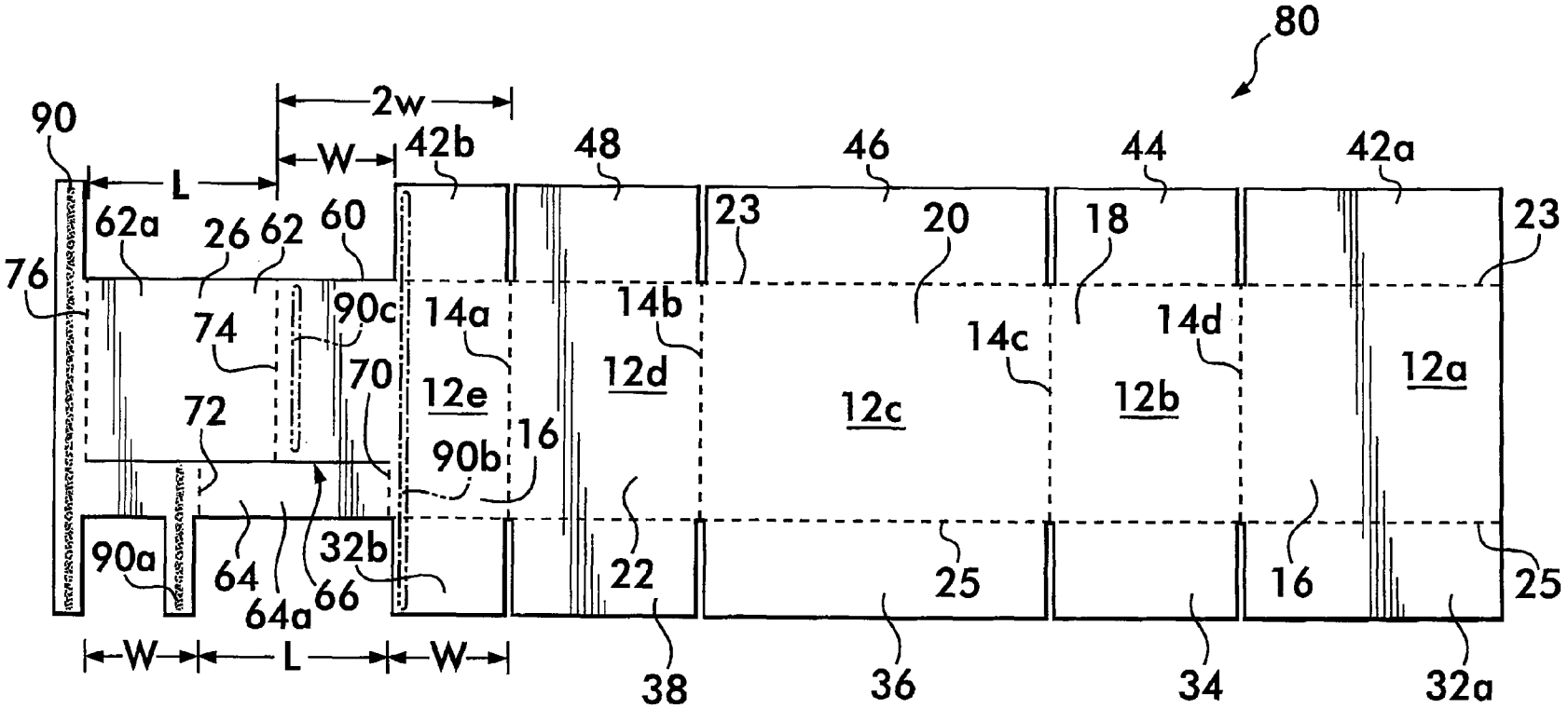
FIG. 2 is a plan view of a blank from which the container shown in FIG. 1 is formed, the Figure showing the inner face of the container, the Figure showing the inner face of the container.
Figure 6:
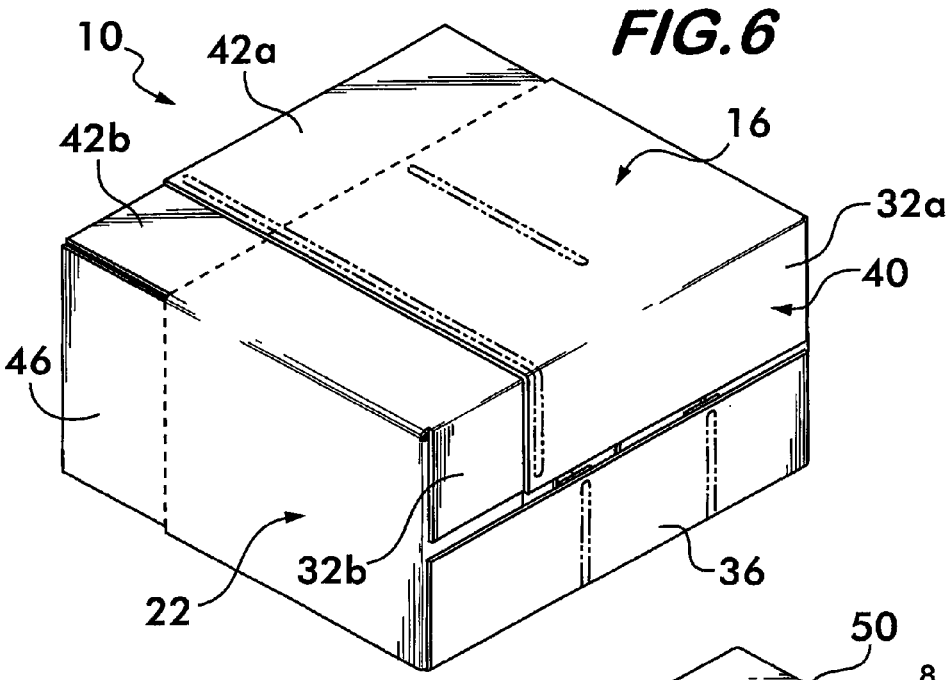
FIG. 6 is a bottom perspective view of the container of FIG. 1 shown in the assembled state with the bottom panels folded.

Bottom flaps 32, 34, 36 and 38 extend respectively from the bottom edge 25 of each sidewall 16, 18, 20 and 22 and are folded inwardly toward the central space 24 along respective fold lines to form a bottom 40, as best shown in FIGS. 2 and 6. It will be noted that in this embodiment bottom flap 32 is made up of flap 32*a* joined to panel 12*a* and flap 32*b* formed to panel 12*e*. Upon folding, the flaps 32, 34, 36 and 38 are positioned substantially co-planarly in overlapping and adjacent positions relative to one another, as best shown in FIG. 6. There are several possible folding combinations used to form bottoms of containers, such as the 1-2-3-4 bottom or the "crash" bottom, all of which are known to those of ordinary skill in the art.

Figure 7:
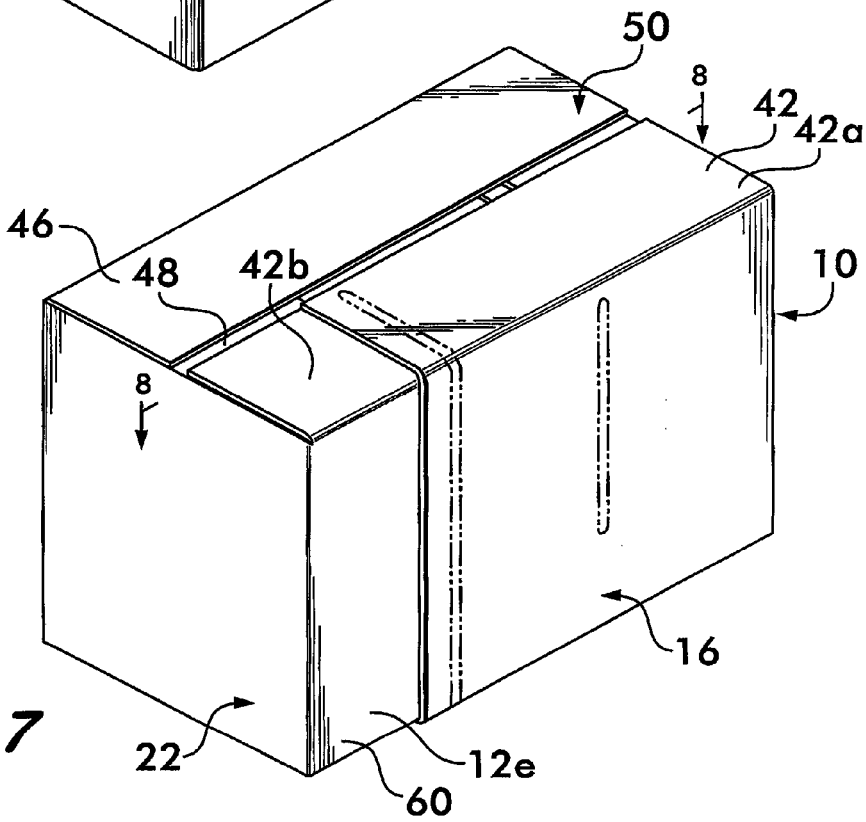
FIG. 7 is a perspective view of the sustainable container of FIG. 1, shown in the assembled state with the top panels folded.

Similarly, top flaps 42, 44, 46, 48 extend respectively from the top edge 23 of each sidewall 16, 18, 20 and 22 and are foldable inwardly toward the central space 24 along respective fold lines to form a top 50, as best shown in FIGS. 1, 2 and 7. It will be noted that in this embodiment top flap 42 is made up of flap 42*a* joined to panel 12*a* and flap 42*b* joined to panel 12*e*. Upon folding, the flaps 42, 44, 46, 48 are positioned substantially co-planarly in overlapping and adjacent positions relative to one another, as best shown in FIG. 6. There are several possible folding combinations used to form the tops of containers, as known to those of skill in the art.

Figures 4, 10:
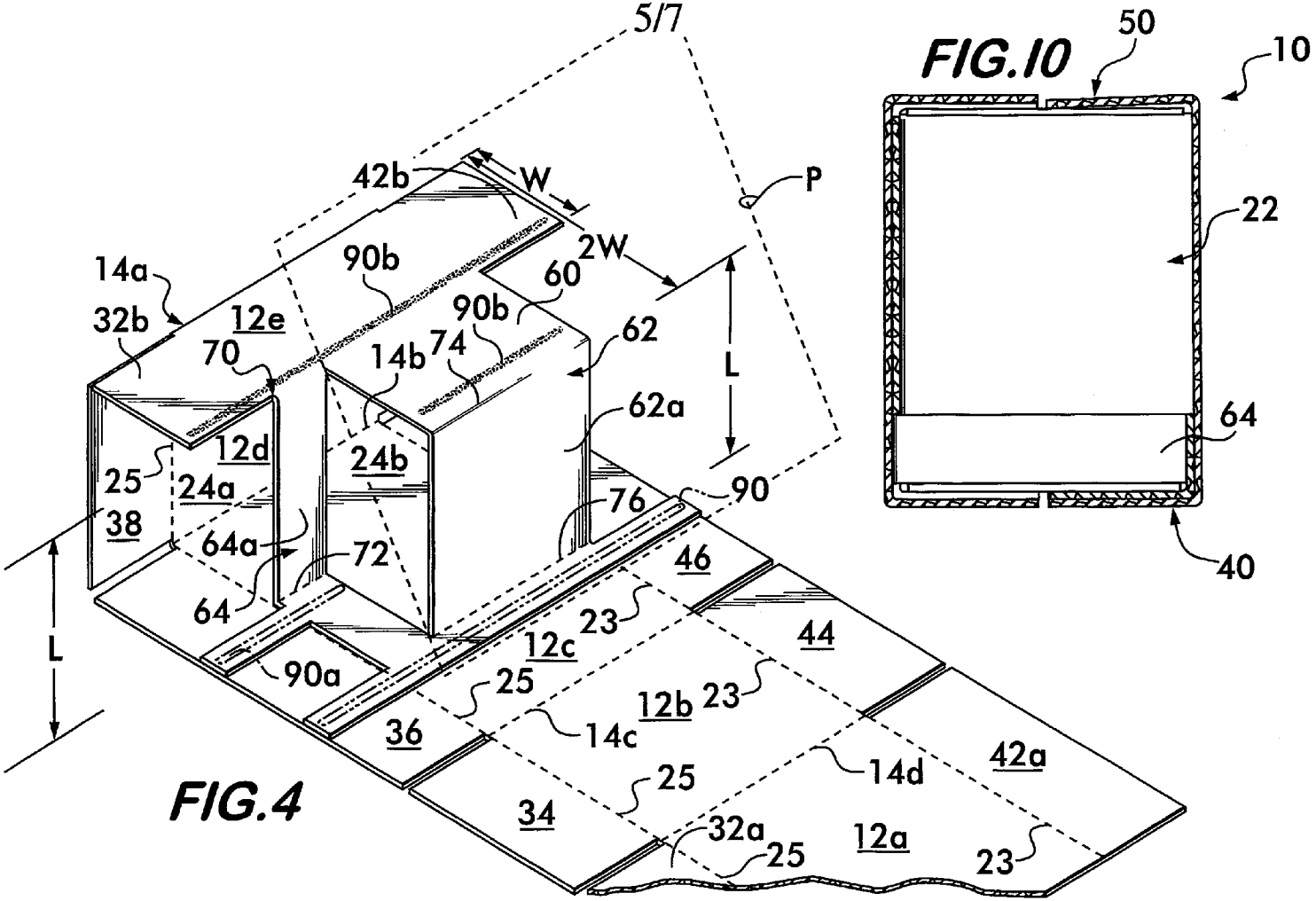
FIG. 4 is a perspective view of the container of FIG. 1 with some of the side panels shown disassembled and peeled away to show the internal divider panels.
FIG. 10 is a cross-sectional view of the container of FIG. 1, taken along line 10-10 of FIG. 1.

In accordance with the present invention, the container 10 includes a divider panel 60 attached to at least one of the panels. In the exemplary embodiment shown in FIGS. 1-10, the divider panel 60, which includes panel 12*e*, is attached to panel 12*d* along side edge 14*a*, as best shown in FIGS. 1 and 2. In the exemplary embodiment, the divider panel 60 is also attached to panel 12*c* that forms sidewall 20, as best shown in FIGS. 1 and 4. The divider panel 60 includes a combination of one or more openings, and one or more fold lines extending transversely to the opening(s) so that the divider panel can be easily folded to form a desired number of cells in the central space 24 of the container 10. In the exemplary embodiment shown, a single opening and four fold lines are used to define three cells, which in this example, are substantially uniform in size.

Figure 3:
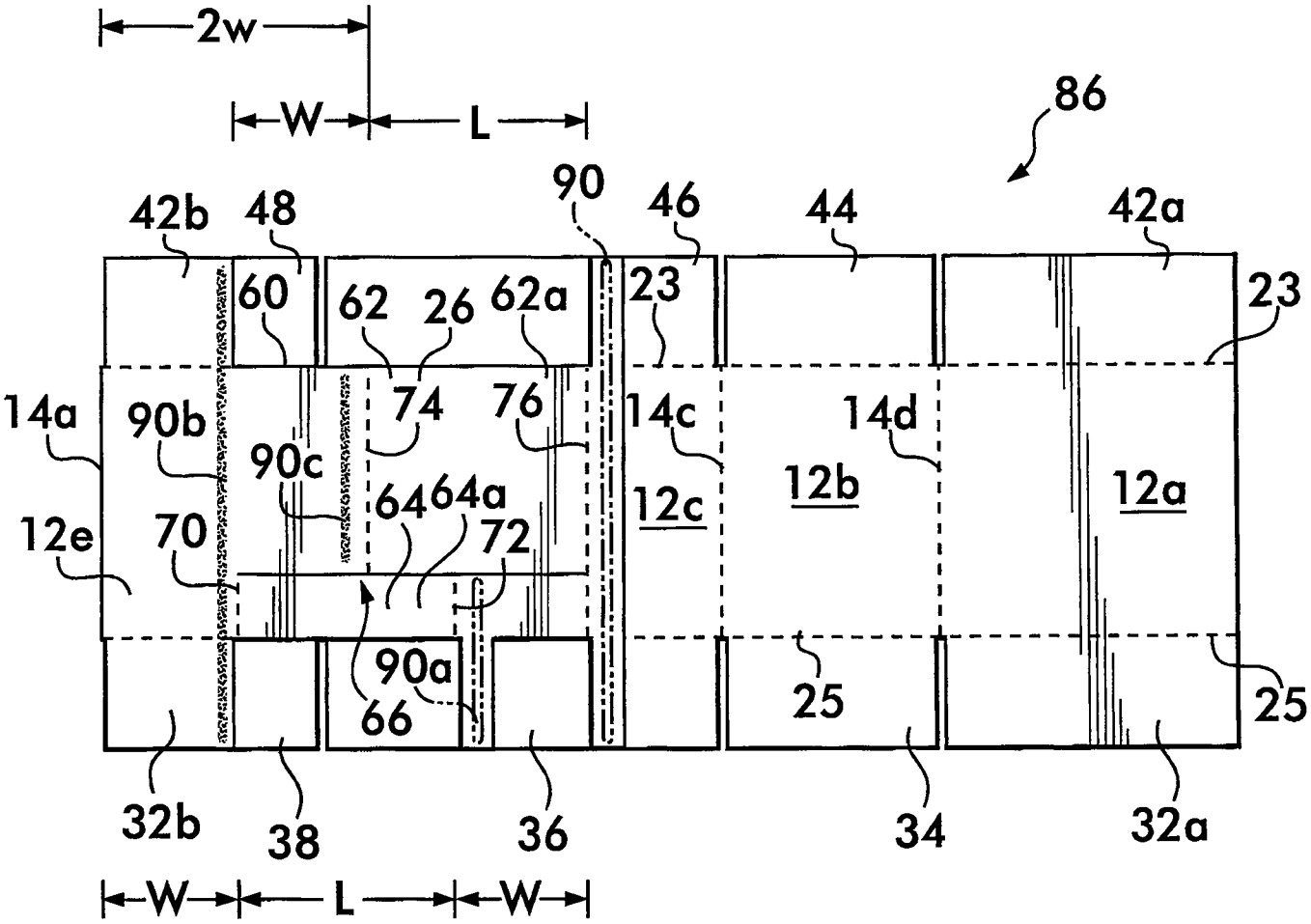
FIG. 3 is a plan view of a partially formed knockdown formed from the blank of FIG. 2 and from which the container shown in FIG. 1 is formed.

The divider panel 60 has an upper portion 62 and a lower portion 64 separated by an opening 66 in the divider panel 60, as best shown in FIGS. 2, 3 and 4. The opening 66 may be formed as a cut or slit through the divider panel 60. The opening 66 separates the divider panel into vertically segmented portions that can be folded out of plane independently of one another. Accordingly, the upper and lower portions 62, 64 initially lie in a plane of the panel, adjacent the opening. The opening extends substantially transversely to the side edges 14*a*, 14*b*, 14*c*, 14*d* of the divider panel 60, as best shown in FIG. 2.

Figure 5:
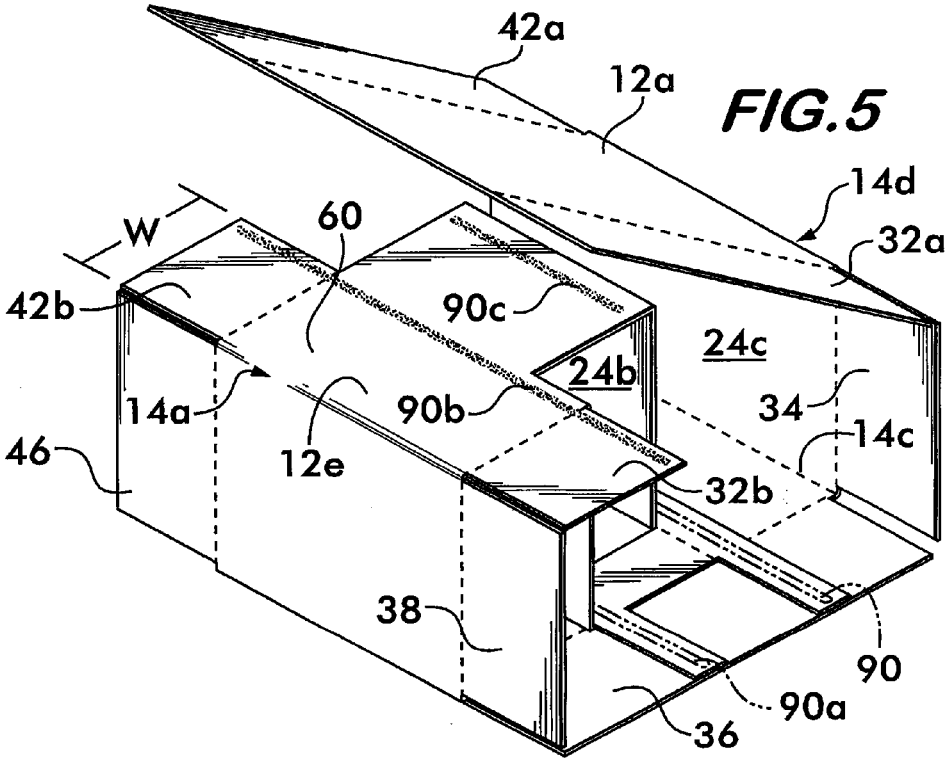
FIG. 5 is a perspective view of the container of FIG. 1, shown with a side panel disassembled and peeled away to show the internal divider panels.

In the assembled state best shown in FIGS. 7-10, and with reference to FIGS. 4 and 5, the upper and lower portions 62, 64 of the divider panel 60 are folded to divide the central space 24 into separate cells, e.g. for receiving one or more objects. In other words, the central space 24 is horizontally segmented into cells by the vertically segmented portions of the divider panel 60. The portions of the divider panel thus define the cells, and physically separate objects, such as the bottles shown for illustrative purposes in FIG. 1, contained with the cells. The divider panel 60 also maintains, or constrains, the positions of the objects within the container 10, to ensure that the objects contained therein are physically positioned within expected locations, to limit shifting of the objects during shipment, and to facilitate pick-and-place, filling, or other manufacturing operations.

More specifically, the upper and lower portions 62, 64 of the divider panel 60 are folded in opposite respective directions out of the plane of the divider panel 60, i.e., out of a reference plane P, as best shown in FIG. 4.

Figure 8:
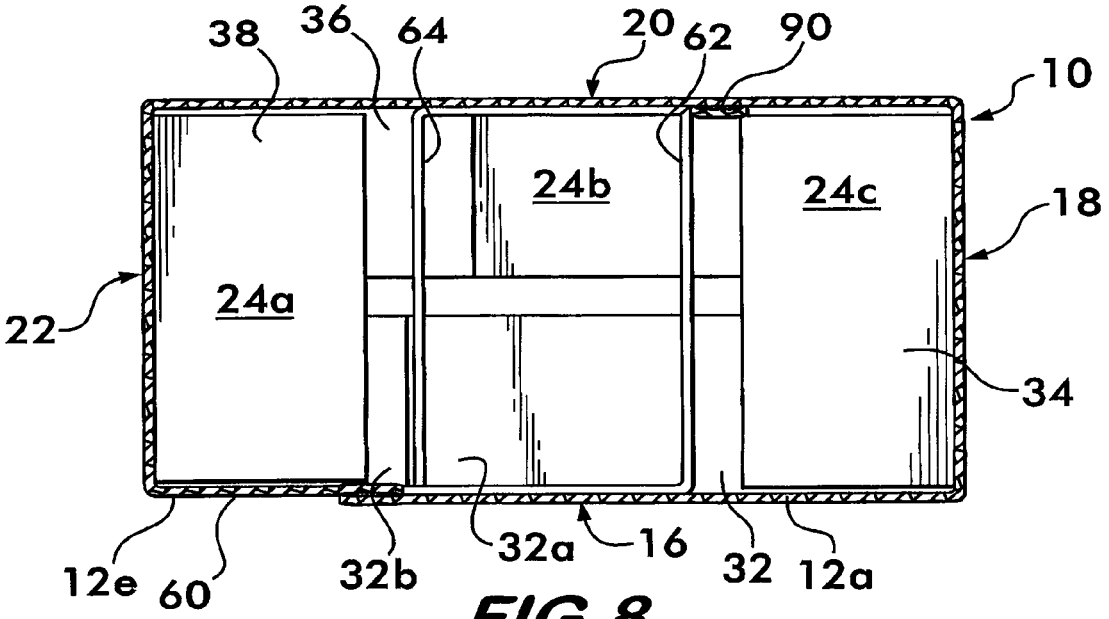
FIG. 8 is a cross-sectional view of the container of FIG. 1, taken along line 8-8 of FIG. 7.

In the exemplary embodiment shown, the lower portion 64 of the divider panel 62 separates cell 24*a* and 24*b*, and upper portion 62 separates cells 24*b* and 24*c*, as best shown in FIGS. 1, 4 and 8, when the container is in its assembled state.

Figure 9:
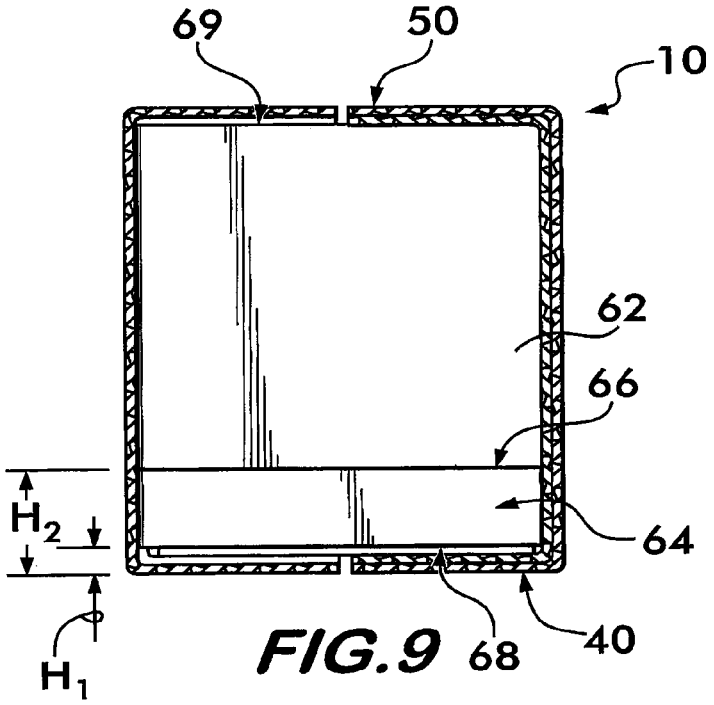
FIG. 9 is a cross-sectional view of the container of FIG. 1, taken along line 9-9 of FIG. 1.

Because of the vertical segmentation of the divider panel 60, the lower portion 64 (extending from a lower edge 68 of panel 60 to opening 66) separates the first and second cells 24*a*, 24*b* beginning at a first elevation $H_1$ above the bottom 40, and the upper portion 62 (extending from opening 66 on panel 60 to an upper edge 69 of panel 60) separates the second and third cells 24*b*, 24*c* beginning at a second elevation $H_2$ above the bottom 40 that is greater than, i.e. above, the first elevation, as best shown in FIG. 9, and as will be further appreciated from FIGS. 1, 4 and 10.

The container 10, shown in FIGS. 1 and 6 in a partially assembled state and in FIGS. 7, 8, 9 and 10 in the assembled state, may be formed from a blank 80, as illustrated in FIG. 2. The blank 80 is preferably a unitary piece of material such as single-layer corrugated paperboard die cut to form the configuration shown in FIG. 2.

Generally, the sidewalls, flaps and other parts comprising the container 10 are joined together at adjacent edges defined by fold lines formed in the blank comprising the container. For containers made of corrugated paperboard, the fold lines may be formed in any of a number of ways, such as by cutting, creasing or perforating the paperboard as is known in the art. For economy of reference herein, when an edge or corner of a part of the container is defined by a fold line, the fold line edge and corner are all denoted by the same reference character. This does not imply, however, that all edges are necessarily fold lines or that all parts of the container need be joined at fold lines in the substrate.

Figure 3A:
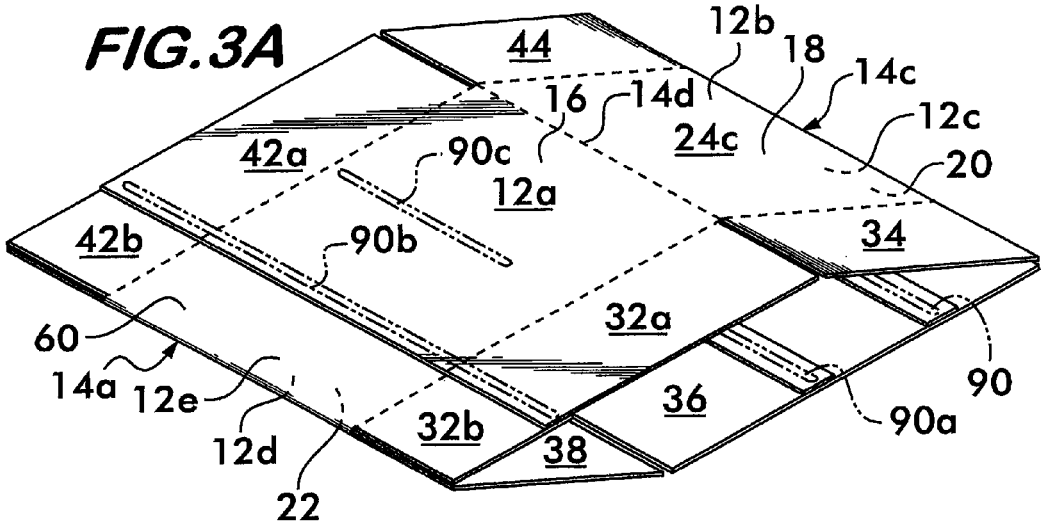
FIG. 3A is a plan view of the almost completed knockdown formed from the partial knockdown shown in FIG. 3 and from which the container shown in FIG. 1 is formed.

The blank 80 forms a knockdown 86 (see FIG. 3A, which shows the knockdown partially opened). In one embodiment, the container is assembleable from its knockdown state (best shown in FIG. 3A) to its assembled state (best shown in FIGS. 1 and 7). The term "knockdown" 86 refers to the configuration of the container 10 in a flat unassembled form, as shown in FIG. 3A (showing the knockdown 86 partially opened). In the knockdown state, the upper and lower portions 62, 64 of the divider panel 60 are disposed substantially in a single plane, as shown in FIGS. 3 and 3A, sandwiched between a first knockdown side formed of panels 12*a*, 12*b* and 12*c* in a second plane (unfolded relative to one another) and a second knockdown side formed of panels 12*c* and 12*d* in a third plane (unfolded relative to one another), as shown. However, the plane is substantially parallel to one another. The knockdown (collapsed) state allows for compact and easy stacking and shipment to the user.

Accordingly, the upper and lower portions 62, 64 of the divider panel 60 move from positions within a plane substantially parallel to panel 20 (see FIG. 3) when the container is in the knockdown state (see FIG. 3A), to positions in opposite respective directions out of the plane as the container is assembled from the knockdown state (see FIG. 3A) to the assembled state (see FIGS. 1, 4 and 5).

To facilitate folding of the divider panel 60 to form the desired cells, the divider panel 60 is provided with a plurality of fold lines extending substantially vertically, transversely to the opening 66, and placed to correspond with the desired number and size of cells to be formed by the folded divider panel 60. It will be appreciated that additional cells may be provided by adding additional openings 66 and divider panel portions, and varying fold line placement on the divider panel 60 and the dimensions of divider panel 60 as needed.

In the exemplary embodiment of FIGS. 1-10, divider panel 60 includes four fold lines. More specifically, as shown in FIGS. 1, 2, 3, 4 and 5, the exemplary divider panel 60 includes a first fold line 70 adjacent the lower portion 64 that extends substantially parallel to the side edge 14*a*. The side edge 14*a* and the first fold are separated by a distance W corresponding to a width of the first cell 24*a*. The divider panel 60 also includes a second fold line 72 on the lower portion 64 that extends substantially parallel to the side edge 14*a*. The first fold line 70 and the second fold line 72 are separated by a distance L corresponding to a length of the first cell 24*a*.

Accordingly, the first and second fold lines 70, 72 are provided on opposite sides of the divider panel 60, as best shown in FIG. 2. This facilitates folding of the lower portion 64 in opposite directions about fold lines 70 and 72, to form the necessary corners, as best shown in FIG. 4.

Additionally, the upper portion 62 of the divider panel 60 includes a third fold line 74 on the upper portion extending substantially parallel to the side edge 14*a*. The side edge 14*a* and the third fold line 74 are separated by a distance corresponding to a combined width (2 W in this example) of the first and second cells 24*a*, 24*b*, as best shown in FIGS. 2 and 4.

In this embodiment, the divider panel 60 further includes a glue tab 90 joined to the upper portion 62 of the divider panel 60 adjacent the fourth fold line 76. Accordingly, the divider panel 60 further includes a fourth fold line 76 adjacent the upper portion 62 and extending substantially parallel to the side edge 14*a*. The third and fourth fold lines 74, 76 are separated by a distance corresponding to a length of the second cell 24*b*, as best shown in FIGS. 1, 2 and 4.

Preferably, the second and third fold lines 72, 74 are provided on opposite sides of the divider panel 60, and the third and fourth fold lines 74, 76 are provided on opposite sides of the divider panel 60 to facilitate folding in opposite directions to form opposite corners. The second and fourth fold lines 72, 76 are separated by a distance corresponding to a width of the second cell 24*b*, as shown in FIGS. 2 and 4.

Accordingly, the first, second, third and fourth fold lines 70, 72, 74, 76 are linearly misaligned on the divider panel 60 when the container 10 is in the knockdown 86 state, as best shown in FIGS. 2 and 3. These fold lines may be arranged in pairs having rotational symmetry about a point to provide equally-sized rectangular cells, as best shown in FIGS. 2 and 3.

To create the knockdown 86 (FIG. 3A) from the blank 80 (FIG. 2), the blank 80 is folded about its fold line 14*a* such that the divider panel 60 and panel 12*e* are folded onto the inner face (shown in FIG. 2) of panel 12*d* and part of panel 12*c*, and the divider panel 60 is secured by one or more glue tabs 90, 90*a* to panel 20 and flaps 36 and 46, as shown in FIGS. 2, 3 and 4. Panels 12*a* and 12*b* of the folded blank 80 (FIG. 3) are then folded about fold line 14*c*, onto the outer side of panels 60 and 12*e*, and panel 12*a* is secured thereto by one or more glue strips, etc. 90*b*, 90*c*, as shown in FIG. 3A. As previously noted, panel 12*a* cooperates with panel 60 and end panel 12*a* to form the sidewall 16 of the container, as shown in FIGS. 1, 2 and 5. Accordingly, a portion (of panel 12*e*) of the divider panel 60 overlies sidewall panel 12*a* in substantially parallel relation when the container is in the assembled state, as best shown in FIG. 1.

To assemble the knockdown 86 (FIG. 3A) into the assembled state (see FIG. 7) of the container 10, the corner formed along side edge 14*a* is pushed generally toward the corner formed along side edge 14*c*. When doing so, this forms corners along side edges 14*b* and 14*d*, and begins to create the basic shape of the container 10 (see FIGS. 4 and 5 showing the knockdown 86 partially opened during assembly of the assembled container 10). This causes the upper and lower portions 62, 64 of the divider to separate and fold about fold lines 70, 72, 74 and 76, as shown in FIG. 4. Accordingly, the upper and lower portions 62, 64 move in opposite directions out of reference plane P as the knockdown 86 is assembled from the blank 80, as shown in FIG. 4. As the knockdown 86 is assembled into the assembled state of the container, this folding is continued until portions 62*a*, 64*a*, of the upper and lower portions 62, 64 extend substantially perpendicularly to panel 20, and substantially perpendicularly to another portion 60*a* of the divider panel 60 that is overlain by panel 16, as best shown in FIG. 4. The folding of these upper and lower portions 62, 64 defines the cells 24*a*, 24*b*, 24*c*. Accordingly, the vertically segmented divider panel 60, which is vertically segmented into upper and lower portions 62, 64, has portions that are folded and adhered to the walls of the container to horizontally segment the central space 24 into separate cells 24*a*, 24*b*, 24*c*.

The container's bottom flaps 32, 34, 36, 38 are then folded to form the bottom 40 of the container 10, as shown in FIG. 6. As shown in FIGS. 2 and 6, flap 32*a* joined to panel 12*a* may be shortened relative to opposite bottom flap 36, such that a flap 32*b* joined to the divider panel 60 (panel 12*c*) cooperates with the portion 32*a* of the flap joined to panel 12*a* to form bottom flap 32.

Objects to be held by the container 10 may then be placed into the cells 24*a*, 24*b*, 24*c* of the container. For illustrative purposes, exemplary bottles 100 are shown in the cells of the container in FIG. 1. It will be noted that in this example, the cells are of substantially uniform shape and size, and are each dimensioned to receive a like number of multiple objects. In the example of FIG. 1, each cell is dimensioned to receive three identical bottles. It should be appreciated that the cells may be different in size and/or shape, and may be dimensioned to receive a single object, different objects, or different numbers of similar or different objects, as desired.

The container's top flaps 42, 44, 46, 48 are then folded to form the top 50 of the container 10, as shown in FIG. 7. As shown in FIGS. 2 and 7, flap 42*a* joined to panel 12*a* may be shortened relative to opposite top flap 46, such that flap 42*c* joined to the divider panel 60 (panel 12*e*) cooperates with the portion 42*b* of the flap joined to panel 12*a* to form top flap 42.

Accordingly, for example, the container may be used as a sustainable container that may be reused for shipping products/objects between geographically diverse manufacturing locations throughout a manufacturing process. For example, the containers may be provided to a bottle manufacturer that may make the bottles, assemble the containers from their knockdown state, and ship the empty bottles in the containers to a product filling facility. The product filling facility may, for example, manufacture the product to be packaged in the bottles, such as a detergent, cleaning solution, beverages, etc., and fill the bottles with the desired product. The integral internal divider provided by the divider panel 60 serves to protect the bottles or other container contents from damage during shipment, e.g., to the product filling facility, and maintains, within an acceptable range, the positions of the bottles relative to one another and/or relative to the container 10 to facilitate pick-and-place, filling or other automated manufacturing operations from locations within the container, even for asymmetrically shaped objects. After the container 10 is loaded with bottles filled with the desired product, for example, the filled bottles may again be shipped in the container 10 to a warehouse, wholesaler, retailer, etc., with the divider panel again protecting the container's contents from damage due to collision or rubbing with one another during transport, and limiting shifting of the contents during shipment.

While there has been described herein the principles of the invention, it is to be understood by those skilled in the art that this description is made only by way of example and not as a limitation to the scope of the invention. Accordingly, it is intended by the appended claims, to cover all modifications of the invention which fall within the true spirit and scope of the invention.

We claim:

1. A container having an integral divider, the container comprising:

a plurality of panels, each of said plurality of panels having respective top, bottom and side edges, said plurality of panels being attached to one another along adjacent side edges to form a plurality of sidewalls surrounding a central space;

a plurality of flaps, each of said plurality of flaps extending from a respective edge of a respective one of said plurality of panels to form a bottom of said container;

a divider panel attached at a proximal edge to one of said plurality of panels forming said sidewalls, said divider panel having an upper divider panel and a lower divider panel separated by a cut extending substantially transversely to said side edges of said divider panel between a first point of integral attachment between the upper and lower divider panels and a second point of integral attachment between the upper and lower divider panels, the upper divider panel being above the cut and the lower divider panel being below the cut, said lower divider panel being foldable in a direction opposite that of the upper divider panel such that the lower divider panel separates first and second cells of said container when said container is in an assembled state and, said upper divider panel separates the second cell and a third cell of said container when said container is in said assembled state, wherein said upper and lower divider panels remain attached at said first and second points of integral attachment in the assembled state, wherein a glue tab extends from a bottom edge of the lower divider panel and is attached to one of the flaps which forms the bottom of said container.

2. The container of claim 1, wherein said divider panel is joined to a side edge of one of said plurality of panels, and wherein said divider panel comprises a score adjacent said lower divider panel extending substantially parallel to said side edge, a distance between said side edge and said score corresponding to a width of one of said three cells.

3. The container of claim 1, wherein said divider panel is joined to a side edge of one of said plurality of panels, and wherein said divider panel comprises a score adjacent said upper divider panel extending substantially parallel to said side edge, a distance between said side edge and said score corresponding to a combined width of two of said three cells.

4. The container of claim 1, wherein said divider panel is joined to a side edge of one of said plurality of panels, and wherein said divider panel comprises:

a first score adjacent said lower divider panel extending substantially parallel to said side edge, said side edge and said first score being separated by a distance corresponding to a width of one of said three cells; and a second score on said lower divider panel extending substantially parallel to said side edge, said first score and said second score being separated by a distance corresponding to a length of one of said three cells.

5. The container of claim 4, wherein said first and second scores are provided on opposite sides of said divider panel.

6. The container of claim 4, wherein said glue tab extending from said lower divider panel is adjacent said second score.

7. The container of claim 4, said divider panel further comprising:

a third score adjacent said upper divider panel extending substantially parallel to said side edge, said side edge and said third score being separated by a distance corresponding to a combined width of two of said three cells; and a fourth score on said upper divider panel extending substantially parallel to said side edge, said third score and said fourth score being separated by a distance corresponding to a length of one of said three cells.

8. The container of claim 7, wherein said second and third scores are provided on opposite sides of said divider panel.

9. The container of claim 8, wherein said third and fourth scores are provided on opposite sides of said divider panel.

10. The container of claim 8, wherein said second and fourth scores are separated by a distance corresponding to a width of one of said three cells.

11. The container of claim 7, said divider panel further comprising a glue tab joined to said upper divider panel of said divider panel adjacent said fourth score, said glue tab being attached to one of said panels.

12. The container of claim 7, said first, second, third and fourth scores being linearly misaligned on said divider panel when said container is in said knockdown state.

13. The container of claim 7, wherein a portion of said divider panel overlies one of said panels in substantially parallel relation when said container is in said assembled state.

14. The container of claim 13, wherein portions of said upper and lower divider panels extend substantially perpendicularly to said portion of said divider panel when said container is in said assembled state.

15. The container of claim 7, wherein said lower divider panel separates a first two of said three cells at a first elevation above said bottom, and wherein said upper divider panel separates a second two of said three cells at a second elevation above said first elevation.

16. The container of claim 1, wherein said lower divider panel separates said first and second cells beginning at a first elevation above said bottom, and wherein said upper divider panel separates said second and said third cells beginning at a second elevation above said bottom, said second elevation being greater than said first elevation.

17. The container of claim 16, said divider panel further comprising a glue tab attached to one of said panels, said upper and lower divider panels moving from positions within a plane substantially parallel to one of said panels, when said container is in a knockdown state, to positions in opposite respective directions out of said plane as said container is assembled from said knockdown state to said assembled state.

18. The container of claim 1, wherein a glue strip extending from the upper divider panel is attached to one of the flaps which forms the top of said container.

19. A container having an integral divider, the container comprising:

a plurality of panels attached to one another along adjacent edges to form a plurality of sidewalls surrounding a central space;

a plurality of flaps extending from said sidewalls to form a bottom of said container; and a divider panel attached to opposite sidewalls, said divider panel having a cut extending transversely thereto separating an upper divider panel and a lower divider panel by passing between a first point of integral attachment between the upper and lower divider panels to a second point of integral attachment, the upper divider panel being above the cut and the lower divider panel being below the cut, said upper and lower divider panels being folded in opposite directions from a reference plane when said container is in an assembled state, said folded lower divider panel separating a first cell of said container from a second cell of said container beginning at a first elevation above said bottom, said folded upper divider panel separating said second cell of said container from a third cell of said container beginning at a second elevation above said bottom greater than said first elevation, wherein said upper and lower divider panels remain attached at said first and second points of integral attachment in the assembled state, wherein a glue tab extends from a bottom edge of the lower divider panel and is attached to one of the flaps.

20. The container of claim 19, wherein said upper and lower divider panels are folded to provide first, second and third cells substantially uniform in size.

* * * * *